US009601844B2

(12) United States Patent
Gassauer et al.

(10) Patent No.: US 9,601,844 B2
(45) Date of Patent: Mar. 21, 2017

(54) SPRING-LOADED CONNECTION TERMINAL

(71) Applicant: WAGO Verwaltungsgesellschaft mbH, Minden (DE)

(72) Inventors: Stephan Gassauer, Ilfeld (DE); Jan Steussloff, Sondershausen (DE)

(73) Assignee: WAGO VERWALTUNGSGESELLSCHAFT MBH, Minden (DE)

( * ) Notice: Subject to any disclaimer, the term of this patent is extended or adjusted under 35 U.S.C. 154(b) by 0 days.

(21) Appl. No.: 14/916,856

(22) PCT Filed: Sep. 1, 2014

(86) PCT No.: PCT/EP2014/068502
§ 371 (c)(1),
(2) Date: Mar. 4, 2016

(87) PCT Pub. No.: WO2015/032718
PCT Pub. Date: Mar. 12, 2015

(65) Prior Publication Data

US 2016/0226160 A1 Aug. 4, 2016

(30) Foreign Application Priority Data

Sep. 4, 2013 (DE) ..... 10 2013 109 640

(51) Int. Cl.
*H01R 4/48* (2006.01)
*H01R 4/40* (2006.01)
*H01R 9/26* (2006.01)

(52) U.S. Cl.
CPC ..... *H01R 4/4863* (2013.01); *H01R 4/40* (2013.01); *H01R 9/26* (2013.01); *H01R 9/2608* (2013.01)

(58) Field of Classification Search
CPC ..... H01R 4/4872
(Continued)

(56) References Cited

U.S. PATENT DOCUMENTS 3,246,283 A * 4/1966 Huska ..... H01R 9/26 439/716
3,304,392 A * 2/1967 Isler ..... H01R 4/4872 337/152

(Continued)

FOREIGN PATENT DOCUMENTS

DE 1917503 10/1969
DE 3013245 A1 7/1981

(Continued)

OTHER PUBLICATIONS

International Search Report and Written Opinion for corresponding International Application No. PCT/EP2014/068502 mailed Dec. 9, 2014.

(Continued)

*Primary Examiner* — Phuong Dinh
(74) *Attorney, Agent, or Firm* — Renner, Otto, Boisselle and Sklar LLP

(57) ABSTRACT

What is described is: a spring-loaded connection terminal (3) comprising a busbar piece (5) which has a base surface (6) and side walls (7) emerging laterally from the base surface (6). Mutually opposite side walls (7) delimit a receiving area (35) on both sides. The spring-loaded connection terminal (3) has a terminal arrangement for the terminal connection of an electrical conductor at an associated clamping point with at least one clamping spring (8), which is operatively connected to the busbar piece (5). At least one current bar (25, 25*a*, 25*b*) which is separate from the busbar piece (5) is introduced into the receiving area (35) of the busbar piece (5) and arranged in the receiving area (Continued)

Figure 1:
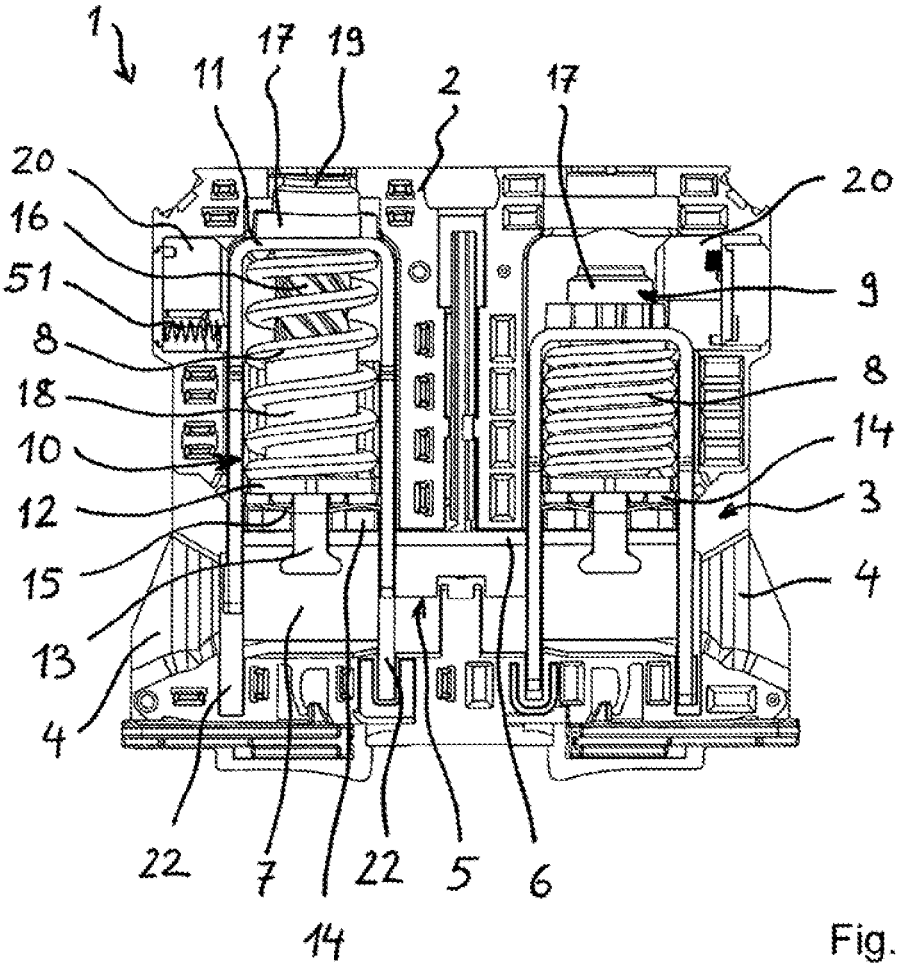

(35) so as to form a clamping surface for the terminal connection of an electrical conductor.

10 Claims, 8 Drawing Sheets

(58) Field of Classification Search
USPC ..... 439/817, 811, 812, 815, 819, 828, 835, 439/728, 813
See application file for complete search history.

(56) References Cited

U.S. PATENT DOCUMENTS

| | | | | |
|---|---|---|---|---|
| 3,539,977 | A * | 11/1970 | Woertz | H01R 4/363 439/723 |
| 4,004,846 | A * | 1/1977 | Woertz | H01R 9/26 439/716 |
| 4,832,628 | A * | 5/1989 | Huska | H01R 4/38 439/716 |
| 6,270,383 | B1 | 8/2001 | Wielsch et al. | |
| 7,404,745 | B1 | 7/2008 | Wu | |
| 7,413,487 | B1 * | 8/2008 | Chen | H01R 4/36 439/709 |
| 7,686,627 | B2 | 3/2010 | Wu et al. | |
| 8,308,516 | B2 | 11/2012 | Gassaur | |

FOREIGN PATENT DOCUMENTS

| | | | |
|---|---|---|---|
| DE | 4409206 | 01 | 5/1995 |
| DE | 19817924 | C2 | 10/1999 |
| DE | 19818604 | 01 | 11/1999 |
| DE | 19916755 | A1 | 10/2000 |
| DE | 102005058307 | A1 | 6/2007 |
| DE | 102005060410 | A1 | 6/2007 |
| DE | 2020008017151 | U1 | 4/2009 |
| DE | 102010023423 | A1 | 12/2011 |
| EP | 0871243 | A1 | 10/1998 |
| EP | 1100156 | A1 | 5/2001 |
| EP | 2395605 | A1 | 12/2011 |
| GB | 727380 | A | 3/1955 |
| GB | 2066589 | A | 7/1981 |
| JP | 6174962 | U | 5/1986 |

OTHER PUBLICATIONS

International Preliminary Report on Patentability for corresponding International Application No. PCT/EP2014/068502 mailed Mar. 8, 2016.

* cited by examiner

SPRING-LOADED CONNECTION TERMINAL

This application is a national phase of International Application No. PCT/EP2014/068502 filed Sep. 1, 2014.

The invention relates to a spring-loaded connection terminal having a busbar piece which has a base surface and side walls which project from the sides of the base surface, wherein opposite side walls delimit a receiving space on both sides, and having a terminal arrangement for terminal connection of an electrical conductor to an associated clamping point, said clamping arrangement having at least one clamping spring which interacts with the busbar piece.

The invention further relates to a terminal component, in particular a terminal block, having an insulating-material housing and having at least one spring-loaded terminal connection of this kind.

Spring-loaded connection terminals for connecting electrical conductors are sufficiently well known in a variety of forms.

For example, DE 1 917 503 A discloses a screw-free connection or connecting terminal having a clamping spring which is mounted on a two-layer, folded-over busbar piece. Furthermore, said document describes a connection terminal having a spiral compression spring which is mounted between a U-shaped tensioning bracket and a busbar piece which is accommodated in the opening in the tensioning bracket. An electrical conductor then forms a terminal connection between a transverse edge of the tensioning bracket and the busbar piece.

DE 10 2005 058 307 A1 discloses an electrical connection terminal having cage tension springs which are mounted on a busbar. The busbar has side walls which are folded over on both sides and which laterally guide an electrical conductor which is guided to a clamping point.

Furthermore, DE 198 18 704 C1 discloses a mounting foot with a grounding conductor function for mounting a high-current terminal. A base plate of U-shaped cross section which is bent away in the direction of a carrying rail in square regions is provided in this case.

A mounting foot, which adjoins a busbar for a spring-loaded terminal connection, for a carrying rail is also described in DE 44 09 206 C1.

Against this background, the object of the present invention is to provide an improved spring-loaded connection terminal.

The object is achieved by the spring-loaded connection terminal having the features of claim 1 and also by the terminal component having the features of claim 10. Advantageous embodiments are described in the dependent claims.

For a spring-loaded connection terminal of this generic type, it is proposed that a current bar, which is separate from the busbar piece, is inserted into the receiving space in the busbar piece, and the current bar is arranged in order to form a clamping point for terminal connection of an electrical conductor.

The insertion of a separate current bar into a receiving space which is delimited by side walls of the busbar piece has the effect that the busbar piece itself can be manufactured from a relatively thin material which is easy to shape such that said busbar piece is optimized for the holding function of the clamping spring and possibly for a guiding function. However, the cross section of and the material selection for the separate current bar can be optimized for the primary current conducting function of said current bar. In this case, the receiving space which is delimited on both sides by the side walls securely receives the current bar while at the same time receiving and guiding the electrical conductor to the current bar in an improved manner. Therefore, owing to the busbar piece being designed separately from an additional current bar, the functions of the two components can be separated.

The busbar piece of U-shaped cross section does not necessarily have to be designed as an electrically conductive metal part in this case. It can also be formed from a different material to the current bar or at least from a metal sheet which is considerably thinner than the current bar.

It is particularly advantageous when the current bar has at least one protruding clamping edge on that side which is opposite the bearing surface of the current bar by way of which the current bar rests on the busbar piece. This ensures that an electrical conductor does not rest flat on the current bar, but rather the clamping force of the clamping spring is concentrated on a defined contact region (contact point) which is provided by the clamping edge. Therefore, it is possible to increase the surface pressure of the electrical conductor on the current bar with the aid of the protruding clamping edges.

The spring-loaded connection terminal has at least one tensioning bracket of U-shaped cross section which is mounted on the busbar piece, such that it can move on the busbar piece, in a direction perpendicular to the plane of the bearing surface of the current bar. The tensioning bracket has at least one transverse web which engages beneath the current bar. In the process, said at least one transverse web and the adjacent current bar form a clamping point for terminal connection of an electrical conductor between the transverse web and the current bar. A clamping spring is operatively connected to the busbar piece and the associated tensioning bracket in order to exert a spring force, which forces the transverse web of the bracket in the direction of the current bar, on the tensioning bracket. Therefore, a clamping force is exerted on an electrical conductor which is positioned between the transverse web and the current bar.

The clamping spring can be, for example, a spiral compression spring. In this case, a spiral compression spring of this kind is positioned between a head section of the U-shaped tensioning bracket, from which two tensioning bracket arms extend at a distance from one another, and the busbar piece. In this case, the spiral compression spring can rest either directly on the busbar piece or on a metal tunnel sheet which is connected to the busbar piece.

However, it is also feasible for the clamping spring to be a cage tension spring which is mounted on the busbar piece. A cage tension spring of this kind has a contact limb which is mounted on the busbar piece, a spring bend which adjoins the contact limb, an operating limb which adjoins the spring bend, and a clamping limb which is deflected from the operating limb in the direction of the busbar piece. The clamping limb has an opening which is delimited by a transverse web. The busbar piece, together with the current bar which bears against it, projects through the opening. In this case, the transverse web, together with the adjacent current bar, forms a clamping point for terminal connection of an electrical conductor between the transverse web and the current bar.

A very compact spring-loaded connection terminal in which lateral guidance is provided with the aid of the busbar piece can be realized with a cage tension spring of said kind. Optimum current transmission with the lowest possible transfer resistance is achieved with the aid of the separate current bar. The busbar piece can be easily folded over with the aid of the busbar piece which is produced from a thin sheet-metal material for example, wherein the wall thickness of the folded-over side walls are relatively thin in order to ensure the smallest possible width of the spring-loaded terminal connection. Therefore, only the separate current bar has to be adapted to meet the requirements for optimum electrical conduction of current and terminal connection of an electrical conductor.

It is particularly advantageous when additional fastening elements for fastening the current bar to the busbar piece are provided. In this way, the busbar piece is not only received into the receiving space, which is delimited at the sides by the side walls, of the busbar piece and mounted in position there, but rather additionally secured to the busbar piece. This can be performed, for example, by riveting, welding, soldering, adhesively bonding or screwing the current bar to the busbar piece. To this end, the current bar and the busbar piece preferably have fastening holes through which the suitable fastening parts, such as rivets, screws or the like, are guided. These fastening parts, together with the fastening holes, form fastening elements within the meaning of the present invention.

Figure 2:
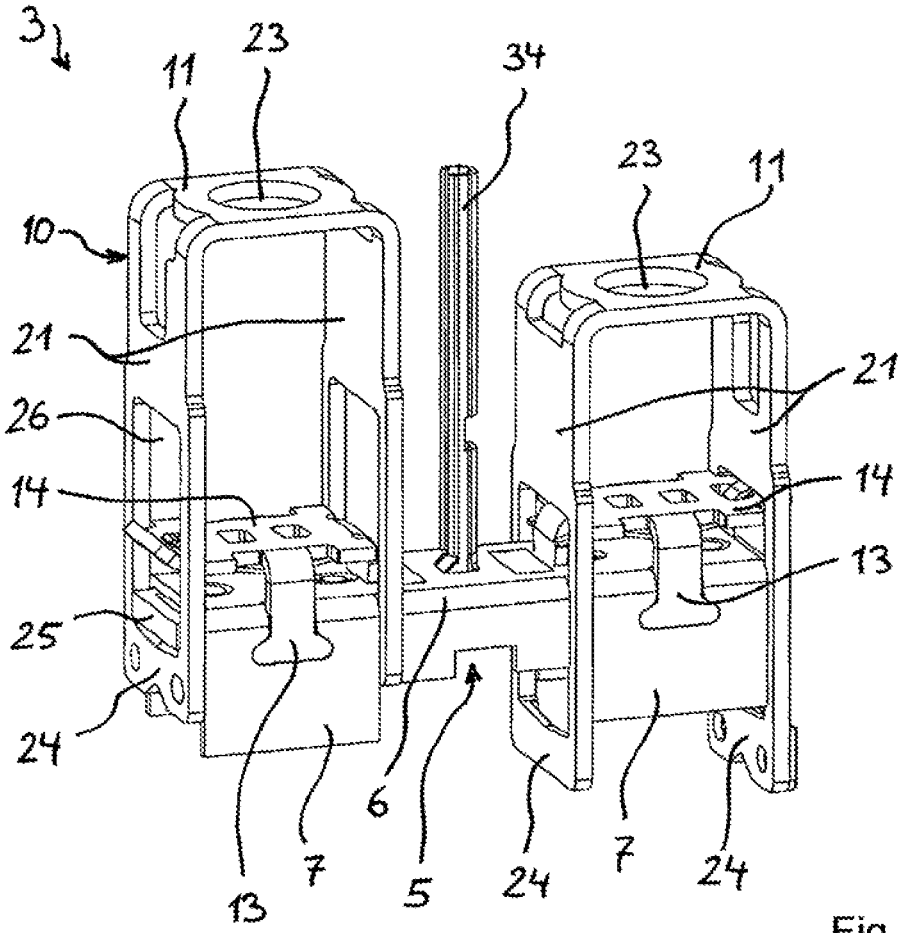
Figure 3:
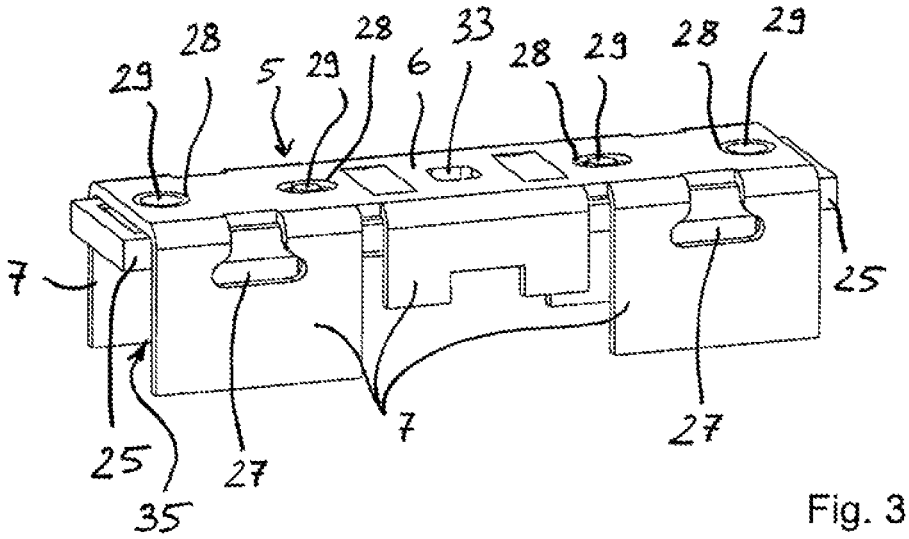
Figure 4:
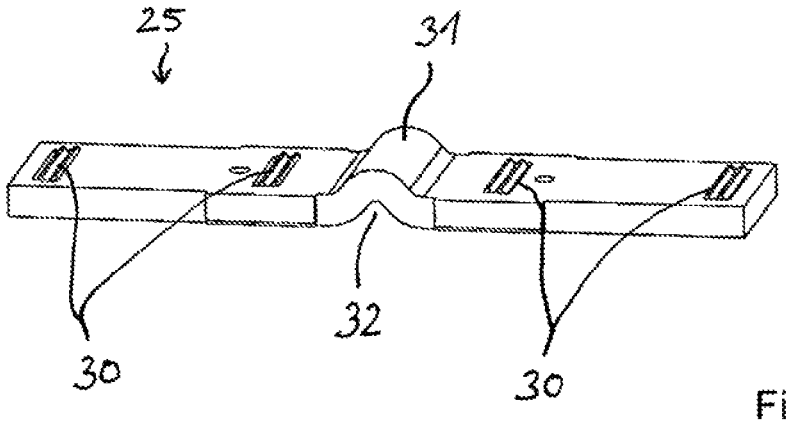
Figure 5:
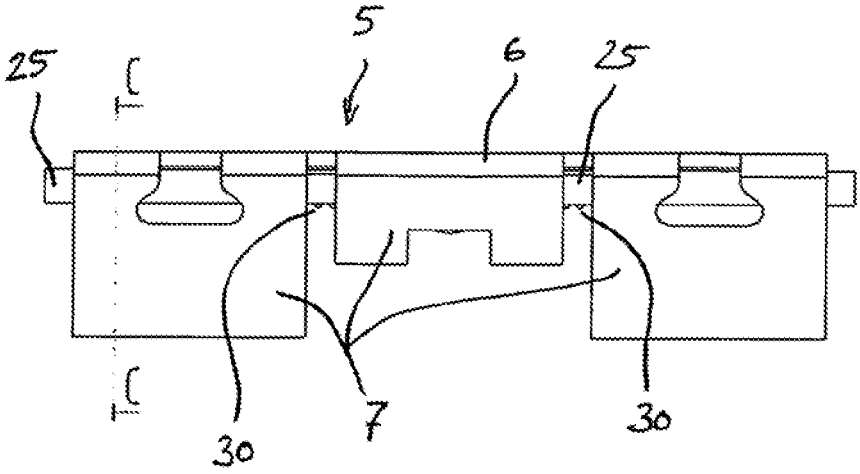
Figure 6:
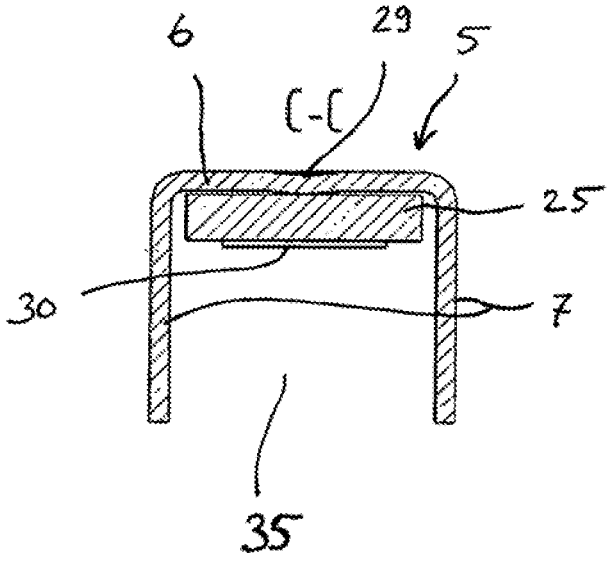
Figure 7:
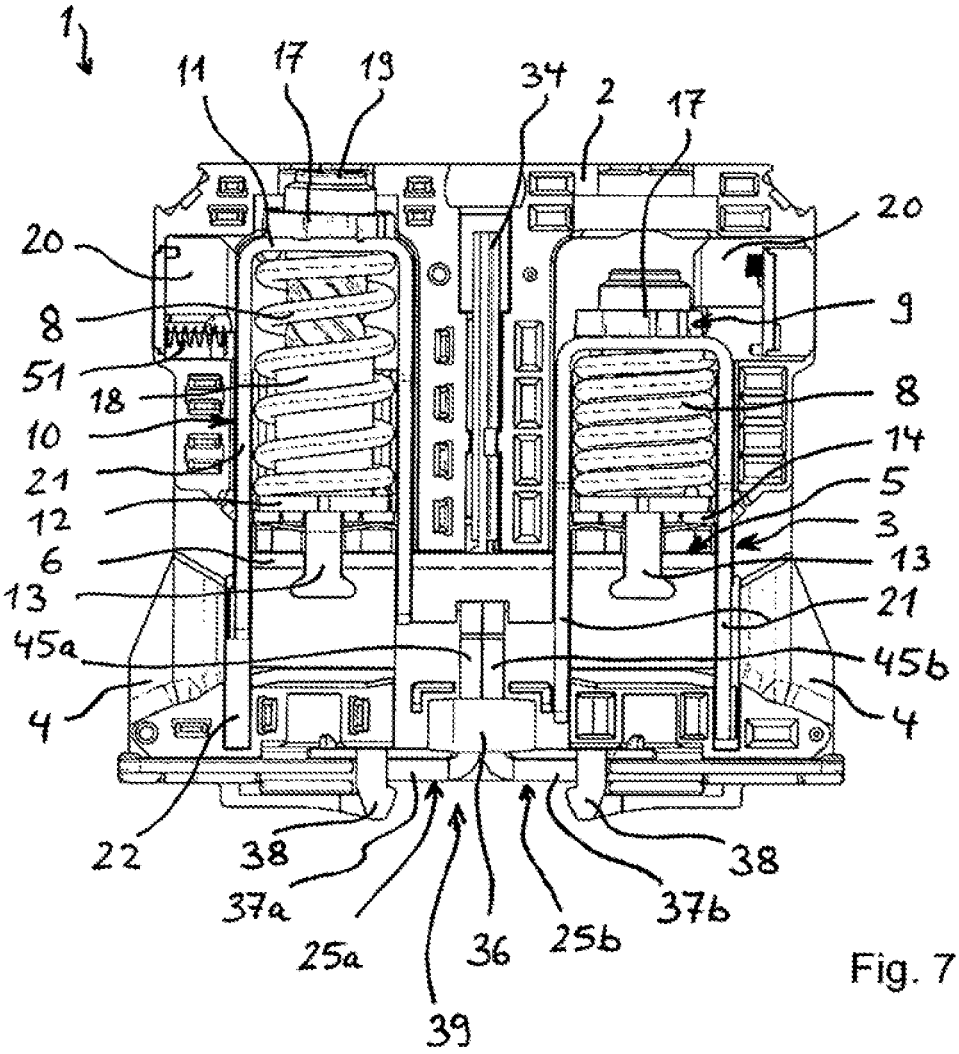
Figure 8:
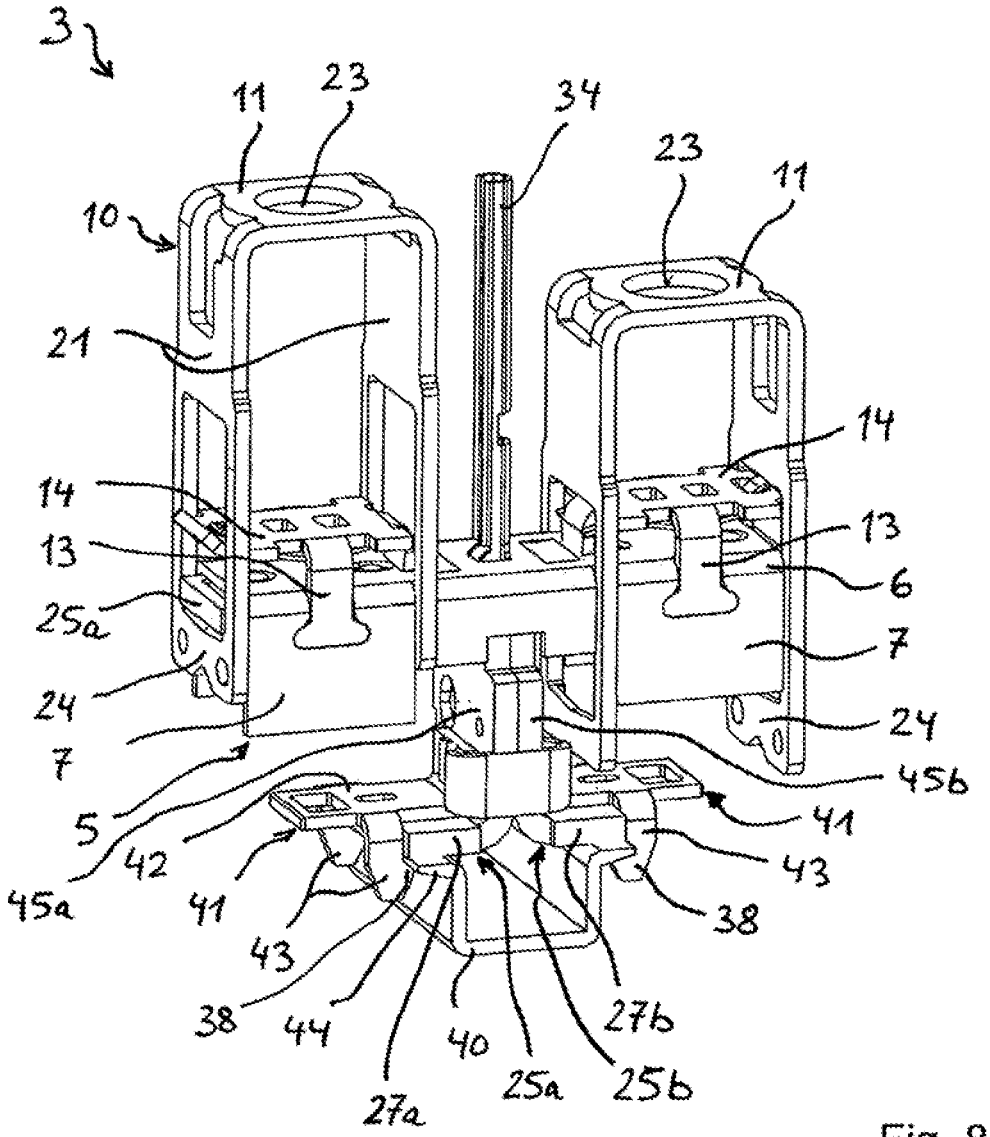
Figure 9:
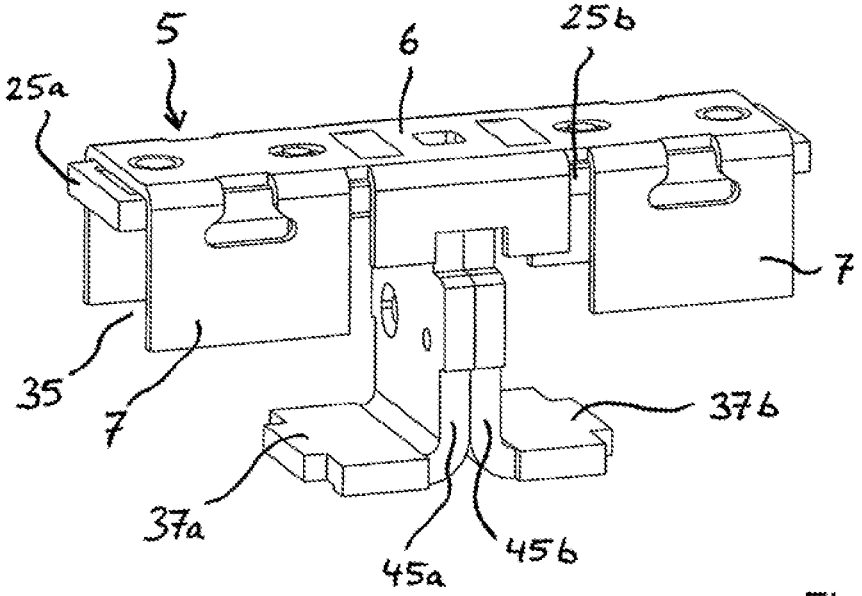
Figure 10:
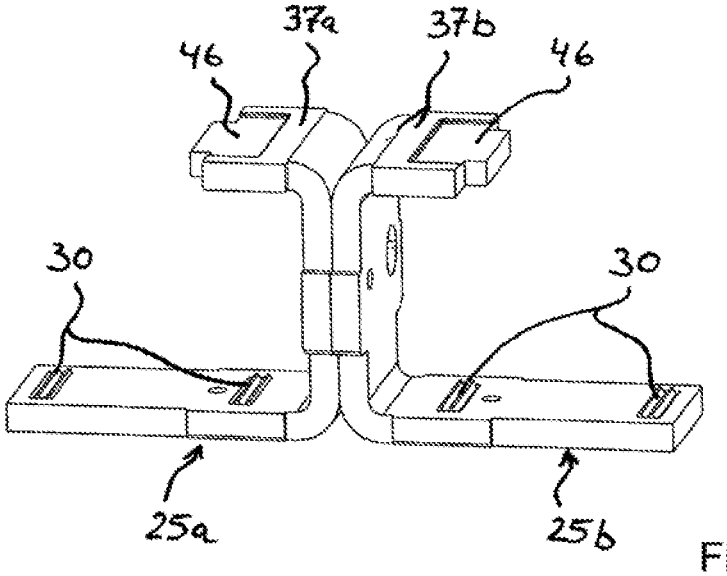
Figure 11:
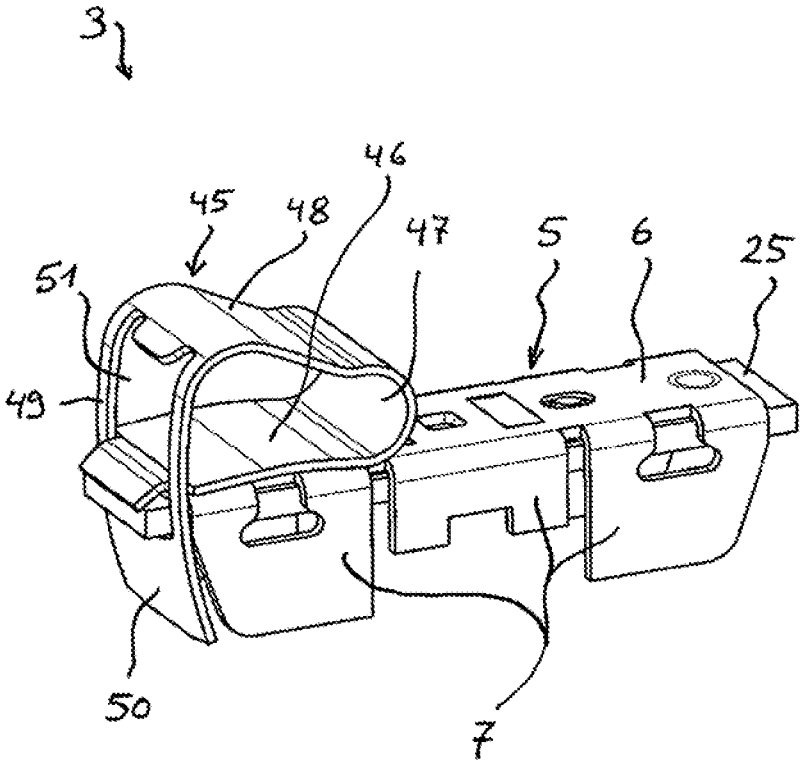

The invention will be explained below with reference to exemplary embodiments, by way of example using the attached drawings, in which:

FIG. 1—shows a side view of a first embodiment of a terminal component of a spring-loaded connection terminal;

FIG. 2—shows a perspective view of a spring-loaded connection terminal for the terminal component from FIG. 1;

FIG. 3—shows a perspective view of a busbar piece of U-shaped cross section with a separate current bar received on said busbar piece;

FIG. 4—shows a perspective view of the current bar for the spring-loaded connection terminal from FIGS. 1 to 3;

FIG. 5—shows a side view of the U-shaped busbar piece with a current bar received on said busbar piece and showing section line C-C;

FIG. 6—shows a cross-sectional view through section C-C through the busbar piece with the current bar from FIG. 5;

FIG. 7—shows a side view of a second embodiment of a terminal component with a spring-loaded connection terminal;

FIG. 8—shows a perspective view of the spring-loaded connection terminal for the terminal component from FIG. 7;

FIG. 9—shows a perspective view of the busbar piece of U-shaped cross section with a two-part current bar received on said busbar piece for forming a PE carrying rail connection;

FIG. 10—shows a perspective view of the two-part current bar for the spring-loaded connection terminal from FIGS. 7 to 9; and FIG. 11—shows a perspective view of a third embodiment of a spring-loaded connection terminal with a tension spring.

FIG. 1 shows a side view of a first embodiment of a terminal component 1 in the form of a high-current terminal block. The terminal component 1 has an insulating-material housing 2 into which a spring-loaded connection terminal 3 is installed. The spring-loaded connection terminal is provided for terminating and connecting two electrical conductors (not visible) which are inserted into conductor insertion openings 4 in the insulating-material housing 2 on opposite sides. The spring-loaded connection terminal 3 has a busbar piece which is of U-shaped cross section and has a base surface 6 and side walls 7 which are angled away from the base surface 6 on both sides. An electrical conductor which is inserted through an associated conductor insertion opening 4 is received in the receiving space between the opposite side walls 7 and the base surface 6. An electrical conductor of this kind is then pushed in the direction of the base surface 6 of the busbar piece 5 with the aid of an associated clamping spring 8 by the spring force of said clamping spring.

Said figure shows that the conductor terminal connection on the left-hand side with the clamping spring 8 which is relieved of tension is in the clamping position in which an electrical conductor would be pushed in the direction of the base surface 6 of the busbar piece 5.

However, the conductor terminal connection on the right-hand side is in the open position in which the clamping spring 8 is compressed with the aid of an operating element 9 in order to open a clamping point for an electrical conductor.

In this case, the clamping point is formed by at least one clamping edge at the lower end of a U-shaped tensioning bracket 10 and by a current bar (not visible) on the base surface 6 in the receiving space, which is delimited by the side walls 7, of the busbar piece 5. It is clear that, in the clamping position in the case of the conductor connection terminal on the left-hand side, the tensioning bracket 10 is shifted upward by the compression spring which is relieved of tension, so that the lower free end of the tensioning bracket 10 moves in the direction of the base surface 6 in comparison to the open position of the conductor terminal connection which is on the right-hand side.

In this embodiment, the clamping spring 8 is a spiral compression spring which is mounted between the base 11 of the tensioning bracket 10 and a metal tunnel sheet 14. The metal tunnel sheet 14 is fastened to the busbar piece 5 by clamping lugs 13. In this case, said clamping lugs 13 engage into recesses in the side walls of the busbar piece 5 in order to fix the metal tunnel sheet 14 in position.

A tunnel sheet-metal spring 15 is arranged between the metal tunnel sheet 14 and the base surface 6 of the busbar piece 5, it being possible for a pin contact of a link to be received and for electrical contact to be made with said pin contact by said tunnel sheet-metal spring between the metal tunnel sheet 14 and the busbar piece 5.

The operating element 9 has a threaded bar 16 which extends concentrically through the clamping spring 8, is mounted in a rotatable manner on a rotary bearing 17 at an upper end and fixed to the base 11 of the tensioning bracket 10 in its direction of longitudinal extent, and forms an axial bearing. The threaded bar 16 enters a corresponding threaded sleeve 18 of a clamping bushing 12 which extends from the metal tunnel sheet 14 in the direction of the base 11 of the tensioning bracket 10 and is fastened to the metal tunnel sheet 14. The threaded rod 16 can be rotated, for example, with the aid of a screwdriver which is inserted into an operating head 19 at the free end of the threaded rod 16. In this case, the threaded rod 16 enters the threaded sleeve 18 or is further unscrewed from the threaded sleeve 18 in order to relieve tension from the clamping spring 8 or to press said clamping spring in order to open the clamping point. In the open position, which is shown for the conductor connection terminal on the right-hand side, the tensioning bracket 10 can be held in the open position with the aid of a locking element 20 which is mounted in the insulating-material housing 2 in a displaceable manner. In this case, said locking element 20 is pushed in the direction of the rotary bearing 17 from outside the insulating-material housing 2, in order to engage over the rotary bearing 17. In this case, the locking element 20 is spring-loaded with the aid of a compression spring 51 in order to automatically return the locking element 20 to the unlocking position (see position of the conductor terminal connection on the left-hand side) when the pressure force which is exerted by the tensioning bracket 10 and the rotary bearing 17 on the locking element 20 is reduced or removed, for example, by slightly pushing down the tensioning bracket 10 in the direction of the busbar piece 5.

Corresponding guide grooves 22 are made in the insulating material housing for the purpose of guiding the opposite tensioning arms 21 of the U-shaped tensioning bracket 10.

FIG. 2 shows a perspective view of the spring-loaded connection terminal 3 for the terminal component 1 from FIG. 1. It is clear from said FIG. 2 that the U-shaped tensioning brackets 10 have a base 11 with an opening 23 for receiving the rotary bearing 17 of the operating element 9. Tensioning arms 21 project from both sides of the base 11 and extend, by way of their free end, below the base surface 6 of the busbar piece 5. Transverse webs 24 are provided at the free ends of the tensioning arms 21 and engage beneath a current bar 25 which is arranged below the base surface 6 of the busbar piece 5 and provide a clamping point for terminal connection of an electrical conductor between the transverse webs 24 of the tensioning brackets 10 and the current bar 25.

It is further clear that the tensioning arms 21 have, for example, rectangular openings 26 through which, in particular, the current bar 25 projects. "Project through" is understood to mean that the current bar 25 projects into the opening 26 regardless of whether the free end of the current bar 25 protrudes out of the plane of the tensioning arm 21 on the other side or not.

A sufficient cross section with an optimally selected material for the current bar 25 in respect of the current conducting function can be provided with the aid of said separate current bar 25. However, the busbar piece 5 can be produced from a relatively thin and easily deformable sheet-metal material, wherein the material selection does not depend on the current conducting capability. The busbar piece 5 can be formed from relatively inexpensive sheet metal or else from other, under certain circumstances also electrically insulating, materials, such as fiber-reinforced plastic for example. Therefore, it is feasible for the busbar piece 5 itself to be produced, for example by injection-molding with suitable fiber reinforcement, as a metal casting or the like.

Said figure further shows that the metal tunnel sheet 14 is fastened to the busbar piece 5 in a manner fixed in position by the bearing arms 13. In this case, the bearing plane of the metal tunnel sheet 14 is at a distance from the base surface 6 of the busbar piece 5, and therefore there is an intermediate space for receiving the tunnel sheet-metal spring 15 (not shown in FIG. 2).

FIG. 3 shows a perspective view of the busbar piece 5 from FIGS. 1 and 2. It is clear that the busbar piece 5 is of U-shaped cross section and has the base surface 6 with side walls 7 which project from both sides of said base surface through 90°. Three sections of side walls 7, which sections are situated one behind the other, are provided over the extent of the busbar piece 5, wherein the two outer side walls are longer than the middle side wall. Fastening openings 27 for receiving the fastening arms 13 of the clamping bushing 12 are provided on each of the two sides of the two outer side walls.

Furthermore, fastening elements in the form of fastening holes 28 are provided in the base surface 6.

The current bar 25 is then fastened to the busbar piece 5 with the aid of rivets, screws or similar fastening elements 29 which project through the fastening holes 28. However, it is also feasible for the current bar 25 to be welded or, under certain circumstances, also adhesively bonded to the busbar piece 5 in the region of the fastening openings 28.

It is further clear that the current bar 25 is received in the receiving space 35 of the U-shaped busbar piece 5, which is delimited by the opposite side walls 7 and the upper base surface, and is longer than the busbar piece 5. In this way, the free ends of the current bar 25 protrude from the busbar piece 5.

FIG. 4 shows a perspective view of the current bar 25 for the spring-loaded connection terminal from FIGS. 1 to 3. The free clamping surface which points away from the base surface 6 in the installed state in FIG. 3 is visible in said FIG. 4. It is clear that clamping edges 30 are provided on this clamping surface in the region of the free ends and at a distance from said free ends in the direction of the center. Said clamping edges 30 are arranged level with the tensioning arms 21 which engage over the current bar 25, so that an electrical conductor is pushed against the associated protruding clamping edge 30 by the transverse web 24 of a tensioning arm 21. In this way, the clamping force of the clamping spring 8 is concentrated on the clamping edge 30 with its reduced surface area and the surface pressure, that is to say the clamping force per unit area, is increased.

Said figure further shows that a protrusion 31 is provided in the central region, a V-shaped clearance between the base surface 6 of the busbar part 5 and the current bar 25 being formed in cross section by said protrusion. A test tap 34 (see FIG. 2) which is guided through a test opening 33 (see FIG. 3) in the busbar piece 5 then enters said test opening 33 by way of its free end and makes electrically conductive contact with the current bar 25.

FIG. 5 shows a side view of the busbar piece 5 with its current bar 25 arranged in the receiving space. It is clear that the current bar 25 rests flat against the busbar piece 5 on the bottom face of the base surface 6. Said figure also shows section line C-C.

FIG. 6 shows the busbar piece 5 in FIG. 5 with the current bar 25 arranged in its receiving space 35. It is clear that the width of the current bar in the exemplary embodiment is smaller than the distance between the opposite side walls 7 and therefore is smaller than the width of the receiving space 35 which is formed by said side walls. The busbar piece 5 is therefore received at a distance from the side walls 7 and adjoins the base surface 6 of the busbar piece 5. Said figure also shows that the protruding clamping edges 30 point downward into the receiving space 35 and therefore away from the opposite base surface 6, in order to form a clamping point for an electrical conductor which is intended to form a terminal connection.

It is further clear that the base surface 6 is deformed in the direction of the current bar 25 in the center in the region of the section C-C, in order to in this way provide an interlocking connection between the busbar piece 5 and the current bar 25.

FIG. 7 shows a second embodiment of a terminal component 1 in the form of a terminal block. With the design of the conductor connection terminals with their clamping springs 8 and the tensioning brackets 10, the design of said second embodiment is comparable to the first embodiment, and therefore reference can be made to the information provided above.

A difference can be found in the configuration of the current bar which, in this embodiment, has two parts and consists of a first current bar part 25*a* and a second current bar part 25*b*. The two current bar parts 25*a*, 25*b* are bent away downward from the base surface 6 of the busbar piece 5 from the plane of the base surface 6 of the busbar piece 5 in the central region in alignment with the test pin opening and the test pin 34 and extend parallel to one another and such that they rest against one another in this region. In the part 45*a*, 45*b* of the current bar parts 25*a*, 25*b* which point away from the base surface 6 of the busbar piece 5 in a perpendicular manner, the two adjoining sections of the current bar parts 25*a*, 25*b* are connected to one another in an interlocking manner, for example, by welding, riveting, caulking, latching or screwing. The sections of the current bar parts 25*a*, 25*b* which extend away from the busbar piece 5 form bearing sections 37*a*, 37*b* which are deflected by way of their free ends so as to point away from one another once again at a distance from the base surface 6. Therefore, a bearing of the terminal component 1 for mounting on a carrying rail (not illustrated) is provided in order to mount the carrying rail on the bearing sections 37*a*, 37*b* and to latch the free side edges of the carrying rail between the bearing sections 37*a*, 37*b* and latching tabs 38 of a latching lug 39 of the terminal component 1.

FIG. 8 shows a perspective view of the spring-loaded connection terminal 3 for the second embodiment with the two-part current bar 25*a*, 25*b* for forming a PE carrying rail connection. An electrically conductive ground contact (PE or grounding conductor contact) is provided in this way in order to electrically conductively connect a carrying rail 40 to the current bar 25*a*, 25*b* and electrical conductors which form a terminal connection on said current bar. Therefore, a grounding conductor terminal block (PE terminal) is provided.

Therefore, the two-part current bar 25*a*, 25*b* can be used firstly to electrically connect the electrical conductors to the carrying rail 40 for providing a grounding conductor contact, and also to mechanically fixedly and securely mount the terminal component 1 on the carrying rail. To this end, carrying rail latching elements 41 which, by way of a base surface 42, rest on the free ends of the bearing sections 37*a*, 37*b* of the current bar parts 25*a*, 25*b* are provided. Two latching fingers 43 are then bent downward away from the busbar piece 5 at the side walls of the free ends of the bearing sections 37*a*, 37*b*, so that latching tabs 38 which are arranged on said latching fingers engage beneath a free side edge 44 of a carrying rail 40. In this way, the carrying rail 40 is latched between the bearing sections 37*a*, 37*b* and the latching lugs 38.

A spring clip 36 engages over the carrying rail latching elements 41 of L-shaped cross section and also engages over the perpendicular parts 45*a*, 45*b* of the current bar parts 25*a*, 25*b*. Therefore, the latching fingers 43 of the carrying rail latching elements 41 are subjected to the action of a force, the forces on said latching fingers being intended to oppose one another, by the spring force of the spring clip 36 in order to latch to a carrying rail 40.

FIG. 9 shows a perspective view of the busbar piece 5 of U-shaped cross section with the two-part current bar 25*a*, 25*b* received in the receiving space 35 in said busbar piece so as to adjoin the base surface 6. In this case, it is clear that, in the central region, the two bearing sections 37*a*, 37*b* are bent away (downward) from the base surface 6 of the busbar piece 5 parallel to the direction of the side walls 7 and extend parallel to one another and so as to adjoin one another. The free ends of the bearing sections 37*a*, 37*b* are then deflected so as to point away from one another at a distance from the base surface 6 (at an angle of approximately 90 degrees+/−10 degrees) in order to form a bearing surface for a carrying rail in this way.

It is further clear that the free ends of the bearing sections 37*a*, 37*b* are tapered by lateral incisions in order to guide the latching element 41 by way of the free ends of the bearing sections 37*a*, 37*b*.

FIG. 10 shows a perspective view of the two-part current bar comprising the current bar parts 25*a*, 25*b*. The current bar parts 25*a*, 25*b* once again have protruding clamping edges 30. It is clear that the current bar parts 25*a*, 25*b* are bent to give a J-shape in cross section, wherein the free ends of the bearing sections 37*a*, 37*b* are substantially shorter than the opposite clamping sections which extend parallel to said bearing sections and rest on the base surface 6 of the associated U-shaped busbar piece 5.

The bearing sections 37*a*, 37*b* have a stamped portion 46 on their side which faces the carrying rail 40, in order to reduce the contact surface area with the carrying rail 40 and therefore to increase the surface pressure for improved current transfer values. The illustrated embodiment provides an optimally shortened current path from the terminal-connected electrical conductor to the carrying rail 40.

FIG. 11 shows a perspective view of a third embodiment of a spring-loaded connection terminal 3 with a cage tension spring 45. The cage tension spring has a contact limb 46, which is mounted on the busbar piece 5 and which is adjoined by a spring bend 47, in a manner which is known per se. In the unoperated clamping state, the spring bend is oriented such that an operating limb 48 adjoins the spring bend at an angle of approximately 45 degrees+/−20 degrees. Said operating limb extends obliquely upward in principle in the direction of the free end of the associated current bar 25 and there is angled so as to form a clamping limb 49, so that the clamping limb 49 extends back in the direction of the current bar 25. The clamping limb 49 has an opening 51 which is delimited by a transverse web 50 and through which the free end of the current bar 25 projects. The transverse web 50 of the clamping limb 49, together with the adjacent current bar 25, then forms a clamping point for terminal connection of an electrical conductor between the transverse web 50 and the current bar 25.

A cage tension spring 45 of this kind can also be arranged on the opposite side. However, it is also feasible for another terminal connection, such as a terminal connection with a tensioning bracket of the first and second embodiment for example, to be formed on said opposite side.

The invention claimed is:

1. A spring-loaded connection terminal having a busbar piece which has a base surface and side walls which project from the sides of the base surface, wherein opposite side walls delimit a receiving space on both sides, and having a terminal arrangement for terminal connection of an electrical conductor to an associated clamping point, said clamping arrangement having at least one clamping spring which interacts with the busbar piece, characterized in that at least one current bar, which is separate from the busbar piece, is inserted into the receiving space in the busbar piece and is arranged in the receiving space in order to form a clamping point for terminal connection of an electrical conductor.

2. The spring-loaded connection terminal as claimed in claim 1, characterized in that the current bar has at least one protruding clamping edge on that side which is opposite the bearing surface of the current bar by way of which the current bar rests on the busbar piece.

3. The spring-loaded connection terminal as claimed in claim 1, characterized in that at least one tensioning bracket (10) of U-shaped cross section is mounted on the busbar piece, such that it can move on the busbar piece, in a direction perpendicular to the plane of the bearing surface of the current bar, wherein the tensioning bracket has at least one transverse web which engages beneath the current bar, wherein the at least one transverse web and the adjacent current bar form a clamping point for terminal connection of an electrical conductor between the transverse web and the current bar, and wherein a clamping spring is operatively connected to the busbar piece and the associated tensioning bracket in order to exert a spring force, which forces the transverse web of the tensioning bracket in the direction of the current bar, on the tensioning bracket.

4. The spring-loaded connection terminal as claimed in claim 3, characterized in that the clamping spring is a spiral compression spring.

5. The spring-loaded connection terminal as claimed in claim 1, characterized in that the clamping spring is a cage tension spring which is mounted on the busbar piece and which has a contact limb which is mounted on the busbar piece, a spring bend which adjoins the contact limb, an operating limb which adjoins the spring bend, and a clamping limb which is deflected from the operating limb in the direction of the busbar piece, wherein the clamping limb has an opening which is delimited by a transverse web, the busbar piece, together with the current bar which bears against it, projects through the opening, and the transverse web, together with the adjacent current bar, forms a clamping point for terminal connection of an electrical conductor between the transverse web and the current bar.

6. The spring-loaded connection terminal as claimed in claim 1, characterized in that the current bar consists of two parts, and the two parts of the current bar have bearing sections which project away from the busbar piece from the bearing surface on the busbar piece, wherein the bearing sections form a bearing means for fastening the spring-loaded connection terminal on a carrying rail and for making electrical contact with the current bar by way of the carrying rail.

7. The spring-loaded connection terminal as claimed in claim 6, characterized in that the bearing sections extend parallel to one another and such that they are supported on one another from that region which adjoins the busbar piece, and in that the free ends of the bearing sections are deflected such that they point away from one another.

8. The spring-loaded connection terminal as claimed in claim 7, characterized in that a latching lug for fastening the current bar to a carrying rail is connected to the free ends of the bearing sections.

9. The spring-loaded connection terminal as claimed in claim 1, characterized by fastening elements for fastening the at least one current bar to the busbar piece.

10. A terminal component, in particular a terminal block, having an insulating-material housing and having at least one spring-loaded terminal connection as claimed in claim 1 in the insulating material housing, wherein the insulating-material housing has at least one conductor insertion opening which leads to an associated clamping point of the spring-loaded terminal connection for inserting an electrical conductor and terminal connection of the inserted electrical conductor to the clamping point.

* * * * *